United States Patent [19]

Jensen

[11] 3,976,403

[45] Aug. 24, 1976

[54] ROTARY VANE FLUID PRESSURE MACHINE

[76] Inventor: Robert L. Jensen, 2339 Lockhill Selma, San Antonio, Tex. 78230

[22] Filed: June 24, 1974

[21] Appl. No.: 482,362

[52] U.S. Cl. ..... 418/32; 418/138; 418/140; 418/146; 418/147

[51] Int. Cl.[2] ..... F01C 21/16; F01C 19/00

[58] Field of Search..... 418/32, 137, 138, 146–148, 418/241, 140

[56] References Cited

UNITED STATES PATENTS

| | | | |
|---|---|---|---|
| 239,574 | 3/1881 | Torrence | 418/140 |
| 609,049 | 8/1898 | Rose | 418/138 |
| 812,688 | 2/1906 | Sharp | 418/138 |
| 1,317,056 | 9/1919 | Waagbo | 418/138 |
| 1,320,531 | 11/1919 | Carroll | 418/138 |
| 1,338,265 | 4/1920 | Townsend | 418/138 |
| 1,342,496 | 6/1920 | Carroll | 418/138 |
| 1,686,505 | 10/1928 | Stastny | 418/138 |
| 2,243,899 | 6/1941 | Fulcher | 418/138 |
| 2,470,656 | 5/1949 | Shorrock | 418/138 |
| 2,909,397 | 10/1959 | Brown | 418/138 |
| 3,132,632 | 5/1964 | Kehl | 418/138 |
| 3,419,208 | 12/1968 | Brewer et al. | 418/137 |

*Primary Examiner*—John J. Vrablik

*Attorney, Agent, or Firm*—Willard J. Hodges, Jr.

[57] ABSTRACT

This device functions as a compressor or pump when driven in rotation, and functions as an engine when driven by expansion energy. A housing encases a vane rotor mounted off center for rotation in a cylinder. The slotted rotor is constructed with vane bearing inserts retaining arcuate cast iron vane bearings adjacent the multiple vanes. Vanes are flexibly secured by vane retainers mounted on a rotatible central shaft surrounded by a bushing functioning as a bearing. Improved sealing means are incorporated encircling the rotor and at the edges of the rotor vanes. The device may be utilized as an internal combustion engine by incorporating fueling and spark means. The machine is particularly suited to be driven by expanding gases such as natural gas, air, fluorocarbon gases, or steam as a motor.

10 Claims, 24 Drawing Figures

ROTARY VANE FLUID PRESSURE MACHINE

CROSS-REFERENCE TO RELATED APPLICATION

This invention is an improvement directly related to inventor's U.S. Pat. No. 3,713,426 entitled "Vaned Rotor Engine and Compressor."

BACKGROUND OF THE INVENTION

Field of the Invention

This invention pertains to machines employing multiple vanes rotatibly mounted in a cylinder with the vanes positioned in rotation by an off center rotor. The space between the vanes and the variable distance between the rotor and the cylinder vary from near zero at the tangent point to a maximum 180° opposite the tangent point. The device creates a series of varying volumes which may be utilized as a compressor, pump, or a motor with suitable selection of porting means.

Description of Prior Art

Numerous vaned pumps, compressors, and engines have been developed and patented. A common limitation of the prior art is the limited number of vanes. Previous designs result normally in a three or four vaned configuration. Such configuration limits torque and efficiency when the prior art devices are utilized as expansion motors.

SUMMARY OF THE INVENTION

This invention pertains to a six-vaned device providing desirable qualities and efficiency as a compressor. The paramount advantage appears when the device is utilized as an expansion driven engine. The larger number of vanes reduces loss through leakage between the vanes and the cylinder. Improved sealing at the point of the rotor vane contact and at the edges of the vanes improves efficiency and a unique seal encircles the rotor minimizing leakage at each end of the rotor. The multiple means for mounting the vane retainers on the central shaft reduce friction and limit the possibility of seizing in the event lubrication failure occurs. The improvements of this device would appear to increase torque and efficiency in an internal combustion engine configuration.

The porting of the preferred embodiment permits driving the device in either direction of rotation pursuant to the desires of the operator. The movement of the rotary control valve can result in driving the device at maximum efficiency in either a clockwise or counterclockwise direction.

For an illustration of the construction of the device, reference is made to the attached drawings where identical reference characters refer to identical or equivalent components throughout the several views and the detailed description of the preferred embodiment.

DESCRIPTION OF THE PREFERRED EMBODIMENT

Figure 2:
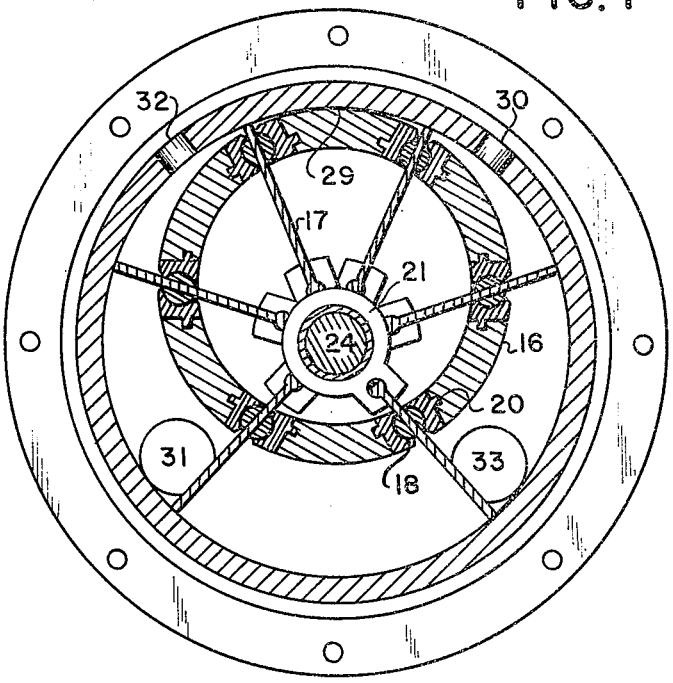
FIG. 2 is a sectional view of the device taken substantially on line 2—2 of FIG. 4 looking in the direction of the arrows.
Figure 3:
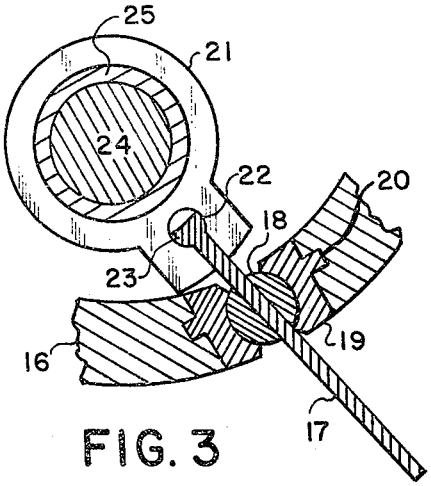
FIG. 3 is a fragmented sectional view of the central shaft, vane retainer, vane, rotor, and vane bearings with insert.
Figure 4:
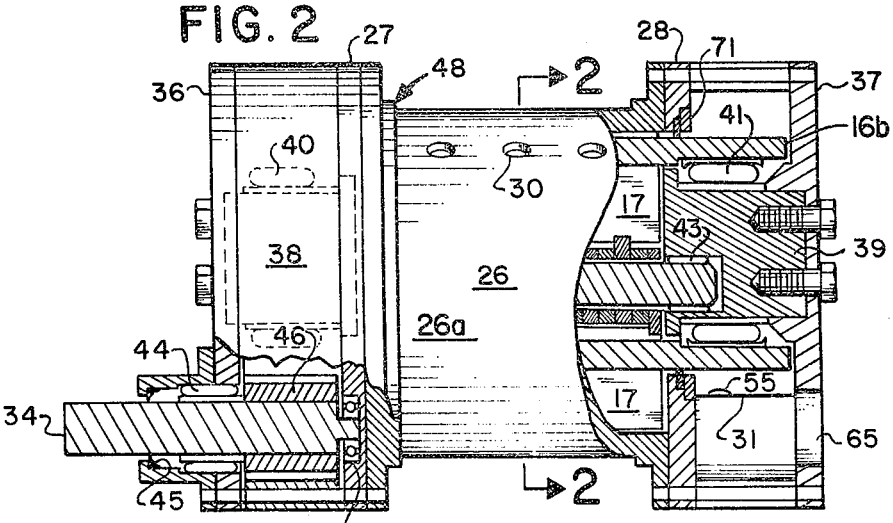
FIG. 4 is a plan view of the assembled device partially fragmented to illustrate internal components at the exhaust end of the device.
Figure 5:
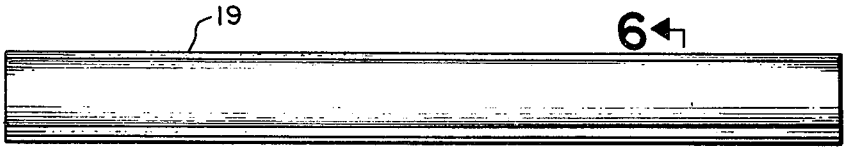
FIG. 5 is an elongated interior view of the vane bearing insert.
Figure 6:
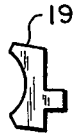
FIG. 6 is a sectional view of the vane bearing insert taken on line 6—6 of FIG. 5 looking in the direction of the arrows.
Figure 7:
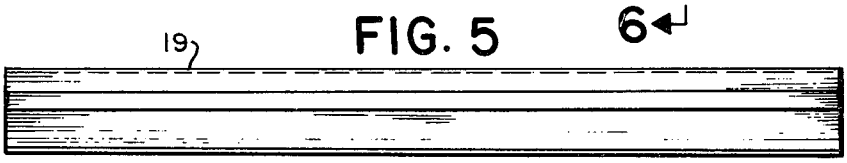
FIG. 7 is an elongated exterior view of the vane bearing insert.
Figure 8:
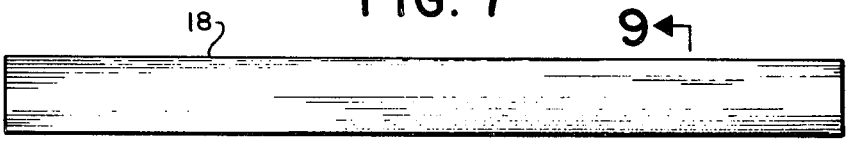
FIG. 8 is an elongated interior view of vane bearing.
Figure 9:
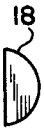
FIG. 9 is a sectional view of the vane bearing taken on line 9—9 of FIG. 8 looking in the direction of the arrows.
Figure 10:
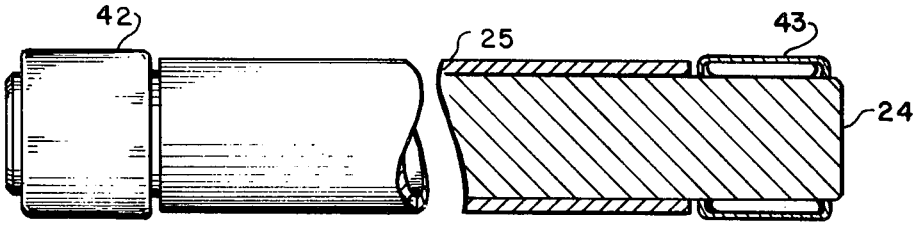
FIG. 10 is an elongated view of the central shaft partially sectionalized to better illustrate further details of the construction.

For an illustration of the construction of the device, reference is made to the drawings. A variety of metals and alloys might be used; however, the preferred embodiment was constructed primarily of high carbon steel utilizing well known machine shop techniques. The rotor 16 is constructed of cylindrical steel tubing with an outside diameter of 4.6 inches. The length was approximately 11½ inches permitting a 2¾ inch bearing support surface on each end. To insure rigidity and stability the rotor 16 is constructed from a solid piece of steel tubing. The machining of the slots in rotor 16 result in a solid integral shaft end 16*a*, a solid integral exhaust end 16*b*, and a slotted central section 16*c* of rotor 16. The six vanes 17 are mounted in slots in the rotor 16 and are 6 inches in length, ⅛ inch thick and approximately 2 5/6 inches wide. For an illustration of the construction of the device at the rotor 16 vane 17 point of contact, reference is particularly made to FIGS. 2 and 3. The vane bearings 18 were constructed of split cast iron rods in the general configuration illustrated in FIG. 8 and FIG. 9. The vane bearing inserts 19 were 6 inches in length and 9/16 inch wide and were of the general configuration illustrated in FIGS. 5, 6 and 7. The vane bearing inserts 19 were constructed of high carbon steel and were retained in rotor 16 by insert slots 20. Vane retainers 21 were constructed of high carbon steel of the general configuration illustrated in FIG. 2 and FIG. 3 including vane retainers slots 22. A circular flared shoulder 23 extends the length of each vane 17 for securely attaching the vane 17 to the vane retainer 21. The central shaft 24 was approximately 8⅛ inches in length and 1 inch in diameter. The central shaft 24 was encased by a freely rotating brass central shaft bushing 25 around which vane retainers 21 were inserted. Cylinder 26 of the preferred embodiment was 6 inches long and had an inside diameter of 6 inches. The cylinder might be constructed of cast iron, steel, or an aluminum alloy, depending upon the tolerance for stress desired in the final product. The first end, shaft end 26*a*, of cylinder 26 has secured to it a shaft face plate 27 and to the opposite end, exhaust end 26*b*, of cylinder 26 is secured the exhaust face plate 28. There is constructed into cylinder 26 adjacent tangent point 29 one or more clockwise inlet ports 30 and constructed in exhaust face plate 28 at a desirable position such as illustrated in FIG. 2 is a clockwise exhaust port 31. In a compatible manner also is constructed a counter-clockwise inlet port 32 and a counter-clockwise exhaust port 33. Output shaft 34 projects into the device and is rotatibly mounted in the shaft face plate 27 an output shaft pilot bearing 35. Spaced from and secured to each end of cylinder 26 spaced from shaft face plate 27 and exhaust face plate 28 is a first end plate 36 and a second end plate 37. Boltably secured to first end plate 36 and second end plate 37 in a manner and configuration as substantially illustrated in FIG. 4 is a first rotor bearing support 38 and a second rotor bearing support 39. Various configurations of construction might be employed for these first rotor bearing support 38 and second bearing support 39. In the construction selected it is desired that the structure be rigid; therefore, abutting shoulders as illustrated in FIG. 4 was a satisfactory and desirable method employed in the preferred embodiment. Mounted on the exterior surface of first rotor bearing support 38 and second rotor bearing support 39 is a first rotor main bearing 40 and a second rotor main bearing 41. Also projecting into these rotor bearing supports 38 and 39 are indentations receiving first central shaft bearing 42 and the second central shaft bearing 43. The output shaft main bearing 44 is mounted in the first end plate 36 in a manner as substantially illustrated in FIG. 4. Also encircling output shaft 34 is an output shaft seal 45. To drive or receive the torque output of the device there is constructed in or securely affixed to output shaft 34 an output shaft gear 46 which is compatible and meshes with rotor gear 47 constructed in the exterior surface of rotor 16; however, this rotor gear 47 might be a unitary structure keyed or secured to rotor 16. The composite structure including the cylinder 26, face plates 27 and 28, and end plates 36 and 37 generally outline or define the casing 48.

Figure 11:
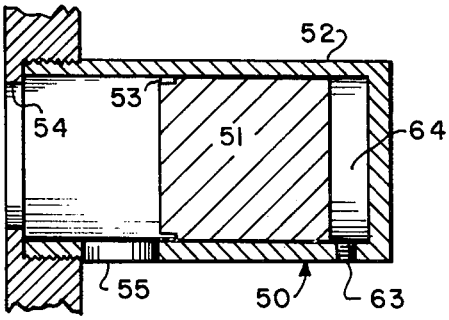
FIG. 11 is a fragmented sectional view of an exhaust valve in the open position.
Figure 12:
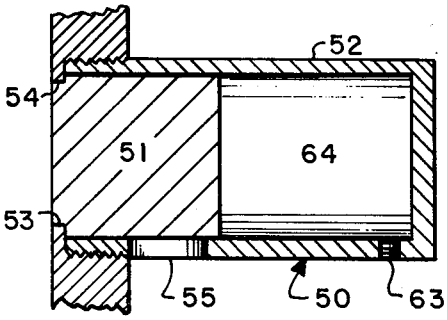
FIG. 12 is a fragmented sectional view of an exhaust valve in the closed position.
Figure 13:
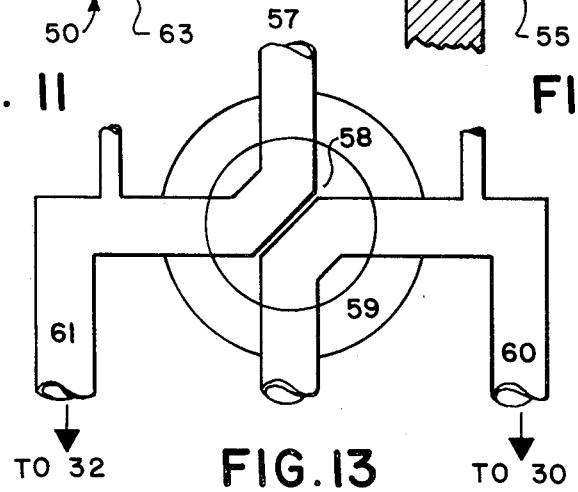
FIG. 13 is a schematic illustration of the control valve, valve control lines.

The preferred embodiment of the device, of particular flexibility, was of an air or gas driven configuration incorporating the foregoing described components as well as the hereinafter described particular adaptations. Two exhaust valve assemblies 50 are of identical construction mounted between exhaust face plate 28 and second end plate 37. The construction of the valve assemblies 50 are best illustrated in FIGS. 11 and 12 and their operation is associated with FIGS. 4 and 13. Each of the exhaust valve assemblies are constructed with an exhaust valve piston 51 mounted in an exhaust valve cylinder 52 a slight indentation machined in the interior end of exhaust valve piston 51 comprises an exhaust valve 53. Valve 53 fits into the exhaust face plate port 54 and exhaust face plate 28 and functions to either open the port as illustrated in FIG. 11 or close the port as illustrated in FIG. 12. Each of the exhaust valve cylinders 52 are constructed with an exhaust cylinder port 55 opening into exhaust collector ring 56 which is of a plenum chamber type construction in the space between exhaust face plate and second end plate 37. Clockwise or counter-clockwise rotation of the device is initiated by pressure received through primary manifold pressure line 57 by selectively positioning of control valve rotor 58 mounted in control valve body 59. Rotor 58 is selectively positioned to feed either clockwise manifold 60 or counter-clockwise manifold 61. The manifolding of the device is associated with the control valve rotor 58 and exhaust collector ring 56 permits the flexibility reversing of the device in driving it in either clockwise or counter-clockwise direction.

Figure 1:
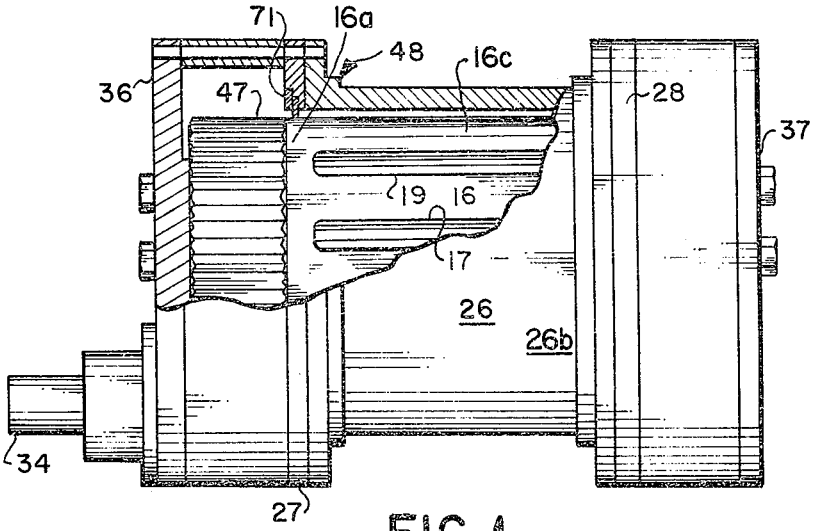
FIG. 1 is a fragmented plan view of the device illustrating the rotor, the rotor vanes and the rotor gear.
Figure 14:
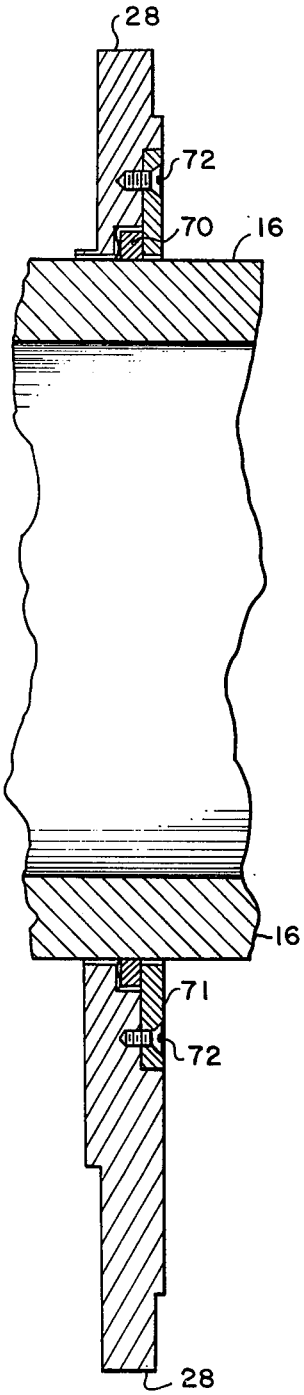
FIG. 14 is a fragmented view of a portion of the rotor as positioned in the exhaust face plate illustrating the rotor sealing means.
Figure 16:
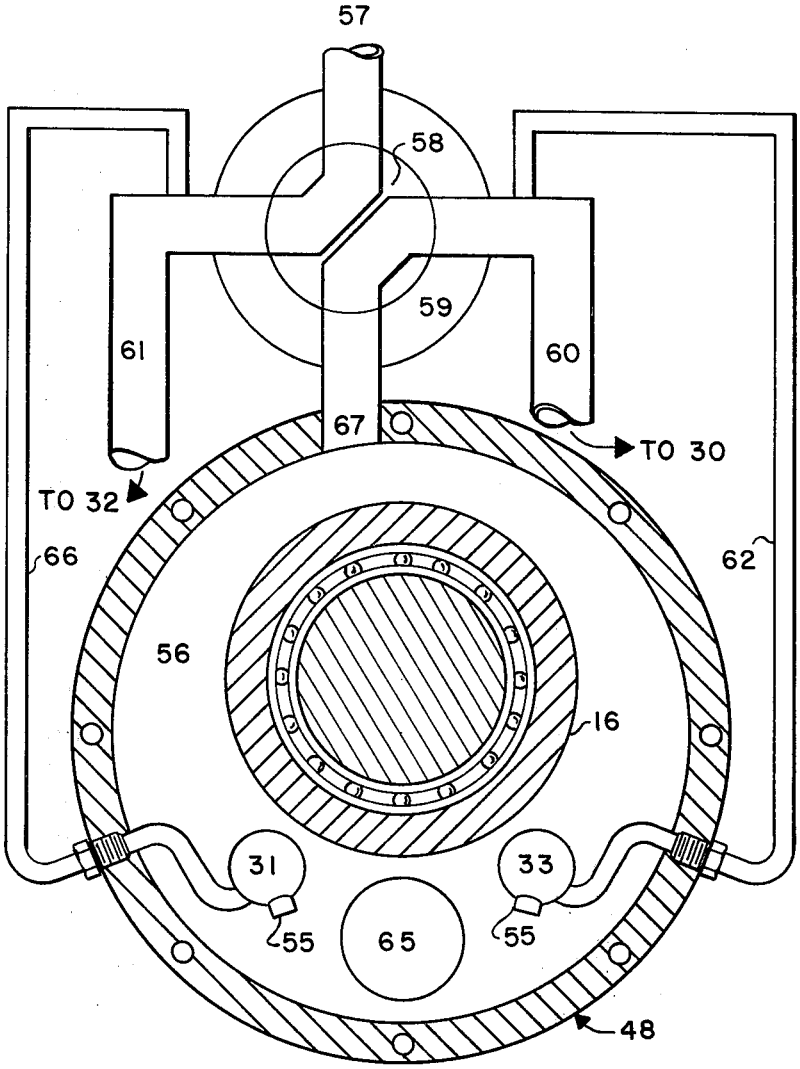
FIG. 16 is a sectional view of the exhaust end of the device combined with a schematic view of the exhaust manifold and port.
Figure 15:
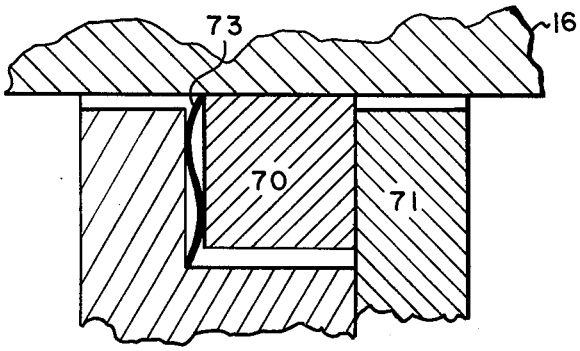
FIG. 15 is an enlarged fragmented view of a portion of FIG. 14 illustrating the detail of the structure at the point of contact with the rotor.

Features contributing to the efficiency of this invention reside in the multiple bearing means in association with the vane retainers 21, central shaft 24, and bushing 25 as well as the improved sealing means of the system. One feature of this improved sealing means is embodied in the vane bearing 18 and vane bearing inserts 19. In addition to the foregoing structures an improved sealing combination is incorporated in rotor sealing ring 70 and retainer 71 encircling each end of the rotor 16 as is illustrated in FIG. 1 and FIG. 4 in detail in fragmented enlarging view of FIG. 14 and FIG. 15. This rotor sealer ring 70 encircles rotor 16 at the exterior contact points of shaft face plate 27 and exhaust face plate 28, FIGS. 14 and 15. Rotor sealing rings 70 are held in position by rotor sealing ring retainer 71 which is affixed to shaft face plate 27 or exhaust face plate 28, FIGS. 14 and 15, by means of series of retainer screws 72. To insure the efficiency of this seal an arcuate or curved rotor sealing ring spring 73 is employed. This insures a flexible firm contact between rotor 16 and the face plates 27,28.

Figure 17:
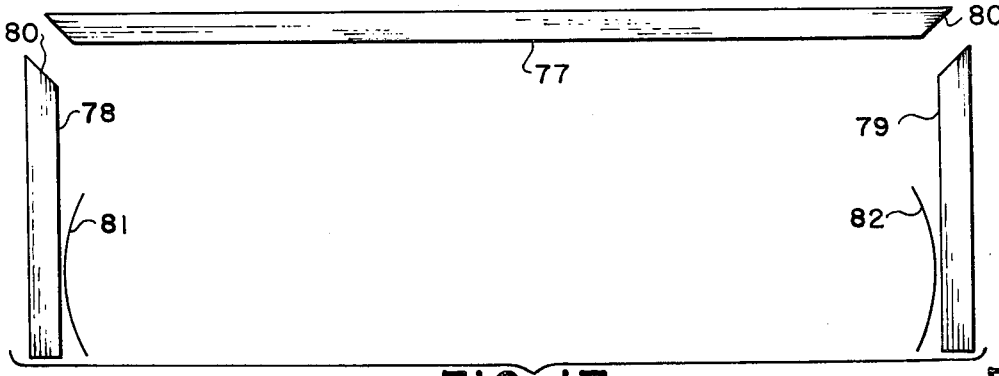
FIG. 17 is a plan view of the vane wipers and springs.
Figure 18:
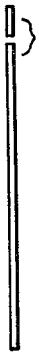
FIG. 18 is an end view of the vane wipers.
Figure 20:
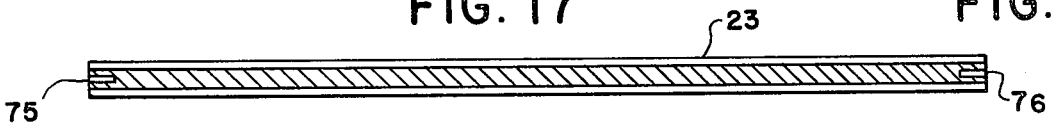
FIG. 20 is a sectional view of the rotor vane taken on line 20—20 of FIG. 19 looking in the direction of the arrows.
Figure 21:
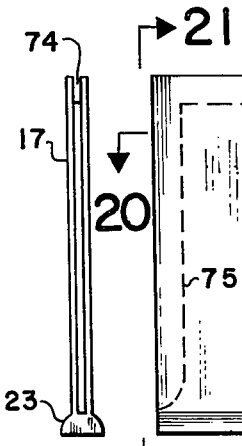
FIG. 21 is an end view of the rotor vane taken from line 21—21 of FIG. 19 looking in the direction of the arrows.
Figure 19:
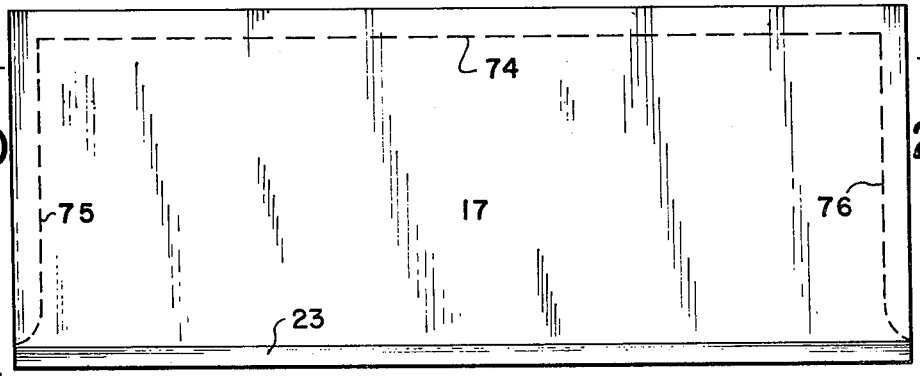
FIG. 19 is a plan view of the improved rotor vane.
Figure 22:
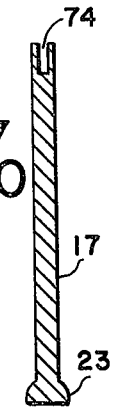
FIG. 22 is a sectional view of a rotor vane taken on line 22—22 of FIG. 19 looking in the direction of the arrows.
Figure 23:
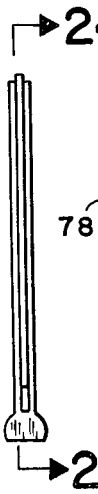
FIG. 23 is an end view of an assembled vane and wipers.
Figure 24:
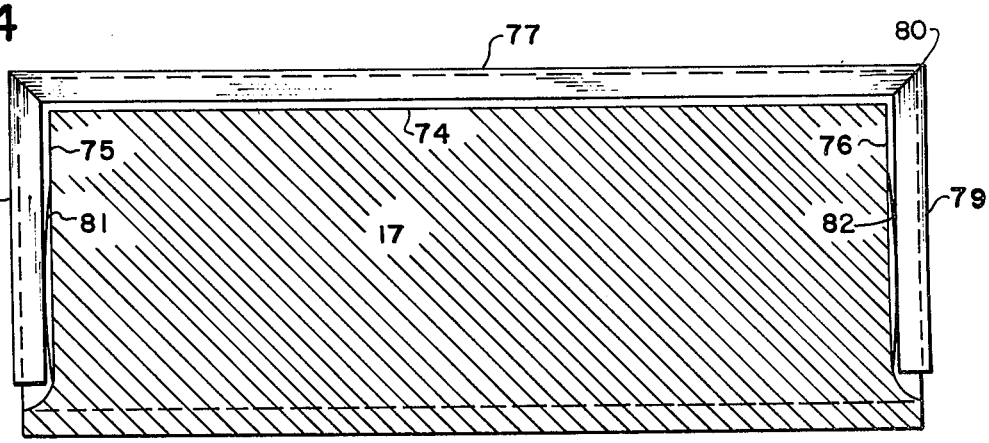
FIG. 24 is a sectional view of the assembled vane disclosing the vane wipers and springs taken on line 24—24 of FIG. 23 looking in the direction of the arrows.

An improvement incorporated in the preferred embodiment resides in the vane edge sealing means illustrated in FIGS. 17 through 24. These improved vanes and seals are constructed by machining vane wiper edge slots 74 in the vanes 17. Dimensions are relatively optional. However, in the preferred embodiment these slots were ¼ inch deep and 53/1000 inch wide. A vane edge wiper slot 74 and and a first vane wiper end slot 75 and a second vane wiper end slot 76 were formed in each vane 17. To complete this component, vane wipers are formed to movably fit in the slots. Various metals, alloys or plastics might be used. In the preferred embodiment strips of cast iron were formed ¼ inch wide and 50/1000 inch thick in substantially the configuration illustrated in FIGS. 17 and 24. These components comprise an edge vane wiper 77, a first end vane wiper 78, and a second end vane wiper 79. The vane wiper contact point 80 of the vane wipers are preferably cut at a 45° angle as illustrated in FIG. 17. The feature of the configuration of this structure is continued efficiency and seal as the wipers were in use. Centrifugal force maintains this contact and seal even though the vane wipers have worn several thousandths of an inch. The preferred structure employed a first end vane wiper spring 81 and a second end vane wiper spring 82 to insure continuous seal of the first and second end vane wipers 78 and 79 against the shaft face plate 27 and the exhaust face plate 28. These vane wiper springs 81 and 82 may be formed of spring wire stock of configuration illustrated in FIGS. 17 and 24.

For an illustrated acceptable construction and assembly procedure of the device of this invention a reading of U.S. Pat. No. 3,713,426 may be of assistance.

OPERATION OF THE DEVICE

The control structures and their functions will be more particularly described in the following description of the operation of the device. The rotation of control valve rotor 58 applying pressure to clockwise manifold 60 results in applying of pressure to the counter-clockwise exhaust valve control line 62. This results in the application of control pressure through control port 63 admitting pressure to exhaust valve control chamber 64 moving piston 51 to the position illustrated in FIG. 12 which closes counter-clockwise exhaust port 33 admitting the rotating pressure applied through clockwise inlet port 30 to rotate the vanes and exhausted through clockwise exhaust port 31 illustrated in FIG. 11. Gases are exhausted through exhaust cylinder port 55, FIG. 11, into exhaust collector ring 56 and discharged through exhaust manifold 65. For counter-clockwise rotation the control valve rotor 58 is positioned to pressurize counter-clockwise manifold 61. This applies pressure to clockwise exhaust valve control line 66 which closes clockwise exhaust port 31 resulting in pressure being applied to counter-clockwise inlet port 32 driving the vanes 17 and the rotor 16 in a counter-clockwise direction exhausting expanded gases through counter-clockwise exhaust port 33. This reversing process is accomplished by a 90° rotation of control valve rotor 58 resulting in a porting of the control line pressure from the system not being driven in rotation through the control valve exhaust 67 into exhaust collector ring 66.

The configuration of the device above described is believed to be capable of incorporation in your applicant's prior invention, U.S. Pat. No. 3,713,426, and the improvements of this invention are believed to be adaptable for utilization in an internal combustion engine or compressor as well as a combined structure. The emphasis of this disclosure, however, is directed to an expansion type motor driven by natural gas, air, steam or fluorocarbon gases.

What is desired to be claimed is all utilizations of this invention not departing from the scope or equivalents as defined in the appended claims:

1. A rotary vane fluid pressure machine comprising:

a. a central shaft means mounted substantially at the center of, b. a casing, the inner surface of said casing defining, c. a cylinder means at a constant radius from central shaft having:

1. a shaft end of said cylinder, and
2. an exhaust end at the opposite end of said cylinder, d. a one piece elongated cylindrical rotor rotatibly mounted off-center of said cylinder means, said cylindrical rotor being constructed with:

1. a contiguous solid integral shaft end,
2. a contiguous solid integral exhaust end, and
3. a central section intermediate said shaft end and said exhaust end, e. multiple vanes having a first side and a second side secured to said central shaft, said multiple vanes projecting through, f. uniform space slots constructed in the central section of said cylindrical rotor, g. vane bearing inserts mounted in said slots in said rotor, h. an insert slot projecting between said vane bearing insert and said uniform spaced slots in said cylindrical rotor for securing said vane bearing insert in said elongated cylindrical rotor, i. cast iron vane bearings mounted in said vane bearing inserts contacting each side of said vanes, j. vane retainers for securing said multiple vanes rotatibly on said central shaft, k. a vane wiper slot constructed in the edge of said vanes opposite the said vane retainers, l. edge vane wipers movably mounted in said wiper slots, m. a clockwise exhaust valve assembly operably mounted adjacent said exhaust face plate, n. a counter-clockwise exhaust valve assembly operably mounted adjacent said exhaust face plate, o. control pressure means for selectively controlling said exhaust valves, and p. control valve means for selectively applying said control pressure to said control pressure means.

2. The invention of claim 1 further comprising multiple central shaft bearings affixed to said casing rotatibly securing said central shaft in said casing.

3. The invention of claim 1 further comprising a central shaft bushing rotatibly mounted on said central shaft juxtaposed said central shaft and said vane retainers, said bushing having dimensional tolerances sufficient to permit relative movement of components causing said bushing to function as a bearing.

4. The invention of claim 1 further comprising:

a. a primary manifold adapted to receive pressurized fluid from an external source, b. a rotary control valve connected to said primary manifold, c. a clockwise manifold operably connected to said rotary control valve, d. a counter-clockwise manifold operably connected to said rotary control valve, e. a counter-clockwise exhaust valve control line interconnecting said clockwise manifold and said counter-clockwise exhaust valve adapted to close said counter-clockwise exhaust valve when said machine is in a clockwise mode of operation.

5. The invention of claim 1 further comprising:

a. the primary manifold adapted to receive pressurized fluid from an external source, b. a rotary control valve connected to said primary manifold, c. a clockwise manifold operably connected to said rotary control valve, d. a counter-clockwise manifold operably connected to said rotary control valve, and e. a clockwise exhaust valve control line interconnecting said counter-clockwise manifold and said clockwise exhaust valve adapted to close said clockwise exhaust valve when said machine is in a counter-clockwise mode of operation.

6. The invention of claim 1 further comprising:
a. a vane wiper end slot interconnecting said vane wiper slot and terminating adjacent said vane retainer,
b. an end vane wiper movably mounted in said vane wiper end slot, and
c. an end vane wiper spring mounted in said vane wiper end slot juxtaposed said end vane wiper and said vane.

7. The invention of claim 1 wherein said casing comprises:
a. a shaft face plate encircling said rotor and sealing said shaft end of said cylinder, and
b. an exhaust face plate encircling said rotor and sealing said exhaust end of said cylinder.

8. The invention of claim 7 further comprising:
a. a rotor sealing ring encircling said rotor adjacent said shaft face plate,
b. a rotor sealing ring retainer securing said sealing ring adjacent said shaft face plate and said rotor,
c. a rotor sealing ring spring juxtaposed said rotor sealing ring and said shaft face plate insuring firm contact between said rotor sealing ring and said rotor sealing ring retainer.

9. A rotary vane fluid pressure machine comprising:
a. a central shaft means mounted substantially at the center of,
b. a casing, the inner surface of said casing defining,
c. a cylinder means at a constant radius from central shaft having:
1. a shaft end of said cylinder, and
2. an exhaust end at the opposite end of said cylinder,
d. a one piece elongated cylindrical rotor rotatibly mounted off-center of said cylinder means, said cylindrical rotor being constructed with:
1. a contiguous solid integral shaft end,
2. a contiguous solid integral exhaust end, and
3. a central section intermediate said shaft end and said exhaust end,
e. multiple vanes having a first side and a second side secured to said central shaft, said multiple vanes projecting through,
f. uniform space slots constructed in the central section of said cylindrical rotor,
g. vane bearing inserts mounted in said slots in said rotor,
h. cast iron vane bearings mounted in said vane bearing inserts contacting each side of said vanes,
i. vane retainers for securing said multiple vanes rotatibly on said central shaft,
j. a vane wiper slot constructed in the edge of said vanes opposite the said vane retainers,
k. edge vane wipers movably mounted in said wiper slots,
l. a shaft face plate encircling said rotor and sealing said shaft end of said cylinder,
m. an exhaust face plate encircling said rotor and sealing said exhaust end of said cylinder,
n. a rotor sealing ring encircling said rotor adjacent said exhaust face plate, o. a rotor sealing ring retainer securing said sealing ring adjacent said exhaust face plate and said rotor, and
p. a rotor sealing ring spring juxtaposed said rotor sealing ring and said exhaust face plate insuring firm contact between said rotor sealing ring and said rotor sealing ring retainer.

10. A rotary vane fluid pressure machine comprising:
a. a central shaft means mounted substantially at the center of,
b. a casing, the inner surface of said casing defining,
c. a cylinder means at a constant radius from central shaft having:
1. a shaft end of said cylinder, and
2. an exhaust end at the opposite end of said cylinder,
d. a one piece elongated cylindrical rotor rotatibly mounted off-center of said cylinder means, said cylindrical rotor being constructed with:
1. a contiguous solid integral shaft end,
2. a contiguous solid integral exhaust end, and
3. a central section intermediate said shaft end and said exhaust end,
e. multiple vanes having a first side and a second side secured to said central shaft, said multiple vanes projecting through,
f. uniform space slots constructed in the central section of said cylindrical rotor,
g. vane bearing inserts mounted in said slots in said rotor,
h. cast iron vane bearings mounted in said vane bearing inserts contacting each side of said vanes,
i. vane retainers for securing said multiple vanes rotatibly on said central shaft,
j. a vane wiper slot constructed in the edge of said vanes opposite the said vane retainers,
k. edge vane wipers movably mounted in said wiper slots,
l. a shaft face plate encircling said rotor and sealing said shaft end of said cylinder,
m. an exhaust face plate encircling said rotor and sealing said exhaust end of said cylinder,
n. a rotor sealing ring encircling said rotor adjacent said shaft face plate,
o. a rotor sealing ring retainer securing said sealing ring adjacent said shaft face plate and said rotor,
p. a rotor sealing ring spring juxtaposed said sealing ring and said shaft face plate insuring firm contact between said rotor sealing ring and said rotor sealing ring retainer,
q. a rotor sealing ring encircling said rotor adjacent said exhaust face plate,
r. a rotor sealing ring retainer securing said sealing ring adjacent said exhaust face plate and said rotor, and
s. a rotor sealing ring spring juxtaposed said rotor sealing ring and said exhaust face plate insuring firm contact between said rotor sealing ring and said rotor sealing ring retainer.

* * * * *